US007263779B1

(12) United States Patent
Wells

(10) Patent No.: US 7,263,779 B1
(45) Date of Patent: Sep. 4, 2007

(54) BRICK LAYING ALIGNMENT APPARATUS

(76) Inventor: Timothy Wells, 3536 Old Pittsburgh Rd., New Castle, PA (US) 16101

( * ) Notice: Subject to any disclaimer, the term of this patent is extended or adjusted under 35 U.S.C. 154(b) by 0 days.

(21) Appl. No.: 11/429,621

(22) Filed: May 8, 2006

(51) Int. Cl.
*E04G 21/18* (2006.01)

(52) U.S. Cl. ..... 33/408

(58) Field of Classification Search ..... 33/407, 33/408, 409, 410, 413, 1 LE
See application file for complete search history.

(56) References Cited

U.S. PATENT DOCUMENTS

| | | | | |
|---|---|---|---|---|
| 2,948,065 | A | 8/1960 | Simonic | |
| 3,119,186 | A | 1/1964 | Stewart | |
| 3,183,595 | A | 5/1965 | Jopperi | |
| 3,461,565 | A | 8/1969 | Harris | |
| 3,555,688 | A * | 1/1971 | Smathers | 33/408 |
| 3,626,434 | A * | 12/1971 | Miller | 33/408 |
| 3,698,089 | A * | 10/1972 | Huston | 33/408 |
| 4,084,321 | A * | 4/1978 | Huston | 33/413 |
| D300,599 | S * | 4/1989 | Ledenican | D8/71 |
| 4,937,946 | A * | 7/1990 | Steinhoff | 33/410 |
| 5,009,015 | A | 4/1991 | Redl | |
| 5,125,162 | A * | 6/1992 | Prebeck | 33/408 |
| 5,129,150 | A | 7/1992 | Sorensen | |
| D347,798 | S | 6/1994 | Tindoll | |

FOREIGN PATENT DOCUMENTS

| | | | |
|---|---|---|---|
| FR | 2666366 | A1 * | 3/1992 |

* cited by examiner

*Primary Examiner*—R. Alexander Smith
(74) *Attorney, Agent, or Firm*—Crossley Patent Law; Mark Ashley Crossley

(57) ABSTRACT

A brick laying alignment apparatus comprising two identical holders fitted with stagger bolts and guide pins. Each holder further comprises a vee on the first end, the vee having a ramp on either side and a wedge in the base of the vee for removable string engagement. The string is pulled taught between the holders, thereby holding them in place on remotely positioned bricks to be used in aligning further bricklaying.

20 Claims, 3 Drawing Sheets

BRICK LAYING ALIGNMENT APPARATUS

BACKGROUND OF THE INVENTION

The difficulties a mason encounters in building a straight wall are well known. Various devices have been developed which aid in that task. A mason is constantly challenged with brick alignment and in developing same with ease and rapidity. Guiding strings or lines are an accepted and well-established tool in alignment. Holding a guide line tightly is an inherent problem in alignment pursuits, as is ease of use of any tools involved in attempting to do so. The present brick laying alignment apparatus provides unique solutions to these problems encountered in masonry.

FIELD OF THE INVENTION

The present invention relates to masonry and more specifically to a brick laying alignment apparatus.

DESCRIPTION OF THE PRIOR ART

Prior art teaches several devices for assisting a mason in aligning bricks. Each has its own merits. Each differs from the present apparatus in design and function. Of additional importance is that the prior art devices are not reversible with regard to top and bottom, as is the present apparatus. The present apparatus also provides for component replacement, which is not taught in the prior art.

U.S. Pat. No. 3,119,186 issued to Stewart on Jan. 28, 1964 teaches a mason's line anchoring device. The device differs from the present brick laying alignment apparatus with regard to diversity, ease of use, and replaceable parts.

U.S. Pat. No. 2,948,065 issued to Simonic on Aug. 9, 1960 teaches a mason's line holding device which assists a mason in building a straight wall. The device, however, is not similar in design and does not offer ease of use and universality of the present brick laying alignment apparatus.

U.S. Pat. No. 3,461,565 issued to Harris on Aug. 19, 1969 teaches a mason's line stretcher whose operation is similar to the present brick laying alignment apparatus. The device, like that of Simonic and others though, lacks the refinements, parts interchangeability, and advantages of the present brick laying alignment apparatus.

While the above-described devices fulfill their respective and particular objects and requirements, they do not describe a brick laying alignment apparatus that provides for the advantages of the present brick laying alignment apparatus. In this respect, the present brick laying alignment apparatus substantially departs from the conventional concepts and designs of the prior art. Therefore, a need exists for an improved brick laying alignment apparatus.

SUMMARY OF THE INVENTION

The general purpose of the brick laying alignment apparatus, described subsequently in greater detail, is to provide a brick laying alignment apparatus which has many novel features that result in an improved brick laying alignment apparatus which is not anticipated, rendered obvious, suggested, or even implied by prior art, either alone or in combination thereof.

To attain this, the brick laying alignment apparatus comprises two separate identical holders. Each holder is placed on a brick to serve as a guide for a mason. The holders are typically placed atop two remotely separated bricks that use a guide between for proper brick alignment of additional bricks to be laid. A string between the two separated holders thereby guides further brick laying. Each holder is placed with a top or bottom of the holder optionally facing upwardly. Each holder features a vee on the first end and a removable guide pin proximal to the second end. The removable guide pin is locked in place with a set screw. The vee of each holder is further comprised of a taper which joins each side of the vee with the outer side of the holder. Each side of the vee is termed a ramp. The tapers and the ramps of the vee provide for smooth guided engagement of the string with the wedge. The string is commonly used in brick alignment. The base or bottom of the vee extends into the wedge. The wedge extends briefly into the length of the holder, medially from the vee. The wedge provides frictional engagement of the string, thereby holding the string to the holder as needed. Each holder is further comprised of removable stagger bolts. The first stagger bolt extends perpendicularly upward from the holder and is most proximal to the vee. The second stagger bolt is more medially disposed and extends perpendicularly downward from the holder. The stagger bolts each, selectively and in conjunction with the guide pin, provide the means for engaging a brick. The holders are placed on remotely separated bricks. The string is anchored within the wedge of one holder and is also circled about the stagger bolt to be proximal to the brick. The string is then stretched to the opposing holder and temporarily anchored in the same fashion to that second holder. Pulling the sting tightly wedges the holders into contact with the bricks and provides a taught line for further brick laying alignment.

The apparatus is offered in a variety of material make-ups, including known metals, alloys, polymers, and plastics. The replacement capabilities of the guide pins and stagger bolts extend the useful life of the apparatus. Varied lengths of all components are provided as needed.

Thus has been broadly outlined the more important features of the improved brick laying alignment apparatus so that the detailed description thereof that follows may be better understood and in order that the present contribution to the art may be better appreciated.

It is therefore an object of the brick laying alignment apparatus to provide a guide for brick laying.

Another object of the brick laying alignment apparatus is to provide temporary attachment of the apparatus to bricks.

It is also an object of the brick laying alignment apparatus to provide quick attachment to and removal from bricks.

And, it is an object of the brick laying alignment apparatus to provide brick attachment with string tension only.

A further object of the brick laying alignment apparatus is to fit a variety of brick sizes.

An added object of the brick laying alignment apparatus is to provide separately replaceable components.

And, it is an object of the brick laying alignment apparatus to be of basic design.

Still another object of the brick laying alignment apparatus is inexpensive manufacture and sale.

These together with additional objects, features and advantages of the improved brick laying alignment apparatus will be readily apparent to those of ordinary skill in the art upon reading the following detailed description of presently preferred, but nonetheless illustrative, embodiments of the improved brick laying alignment apparatus when taken in conjunction with the accompanying drawings.

In this respect, before explaining the current embodiments of the improved brick laying alignment apparatus in detail, it is to be understood that the brick laying alignment apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved brick laying alignment apparatus. It is therefore important that the claims be regarded as including such equivalent constructions insofar as they do not depart from the spirit and scope of the brick laying alignment apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 4 thereof, the principles and concepts of the brick laying alignment apparatus generally designated by the reference number 10 will be described.

Figure 1:
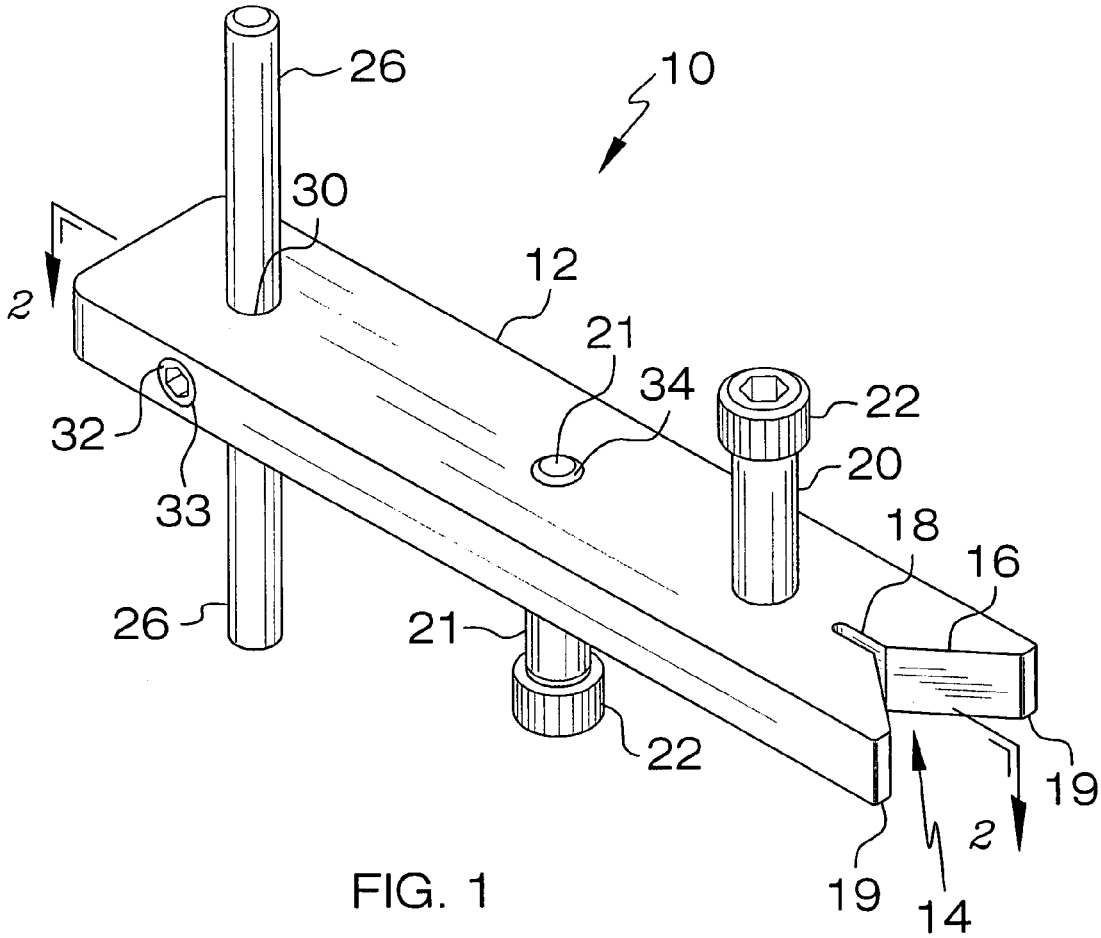
FIG. 1 is a top perspective view.

Referring to FIG. 1, the apparatus 10 comprises a pair of separate, identical parallelepiped holders 12. Each holder 12 is comprised of a length, a width, a thickness, a first end and a second end, and a top and a bottom. Each holder 12 further comprises a vee 14 in the first end of the holder 12. The vee 14 has a length and width. The vee 14 length is coplanar to the holder 12 length. The vee 14 width is coplanar to the holder 12 width. A ramp 16 forms each of the opposite sides of the vee 14. A taper 19 is disposed at the outer origination of each ramp 16 of the vee 14. Each taper 19 joins a side of the thickness of the holder 12 with one of the ramps 16 of the vee 14. The tapers 19 provide for guidance in engaging the string 40 with each holder 12. The tapers 19 also prevent abrasion of the string 40. The ramps 16 end at the bottom of the vee 14. The bottom of the vee 14 meets the wedge 18. The wedge 18 is longitudinally open into the vee 14 and into the holder 12. The wedge 18 is therefore in the inner bottom of the vee 14. The length of the wedge 18 is coplanar to the length of the vee 14 and the holder 12. The wedge 18 is open through the top and bottom of the holder 12. While the wedge 18 is illustrated as a constant width, the wedge 18 is not restricted to such. The wedge 18, in other embodiments of the apparatus 10, tapers to a smaller opening as the wedge 18 progresses medially toward the first bolt A 20.

The guide pin 26 passes through the thickness of the holder 12. The guide pin 26 is proximal to the second end of the holder 12. The guide pin 26 fits within the pin orifice 30 of the holder. The guide pin 26 is perpendicular to the length and width of the holder 12. The guide pin 26 extends out of the bottom and top of the holder 12. The guide pin 26 is held in the desired position by the set screw 33. The set screw 33 fits within the set screw opening 32 disposed in the side of the holder 12. The set screw 33 is therefore perpendicular to the length of the holder 12. The set screw 33 is a hex screw. The set screw 33 retention of the guide pin 26 provides for guide pin 26 adjustment. The guide pin 26 is selectively positioned with reference to protrusion of the guide pin 26 from the top and bottom of the holder 12. The stagger bolt A 20 is disposed proximal to the wedge 18. The stagger bolt A 20 is parallel to the guide pin 26. The bolt 20 extends upwardly from the top of the holder 12. The bolt 20 is preferably comprised of a hex wrench head 22. The hex wrench head 22 provides the externally rounded head 22 of the bolt 20. Were the bolt 20 of a typical outer hexagonal head surface, eventual scarring and rounding of the bolt 20 would render the bolt 20 unworkable with a typical end wrench. Replacement of bolt 20 and stagger bolt B 21 is a valuable feature due to the fact that most bricks 50 (FIG. 4) of various types are abrasive. Replacement capability of bolt 20 and bolt 21 thereby greatly extends the life of the apparatus 10. The second stagger bolt B 21 is spaced apart from bolt 20. Bolt 21 projects perpendicularly from the bottom of the holder 12. Bolt 21 is more medially disposed within the holder 12, compared to bolt 20. Bolt 21 is identical to bolt 20.

Figure 2:
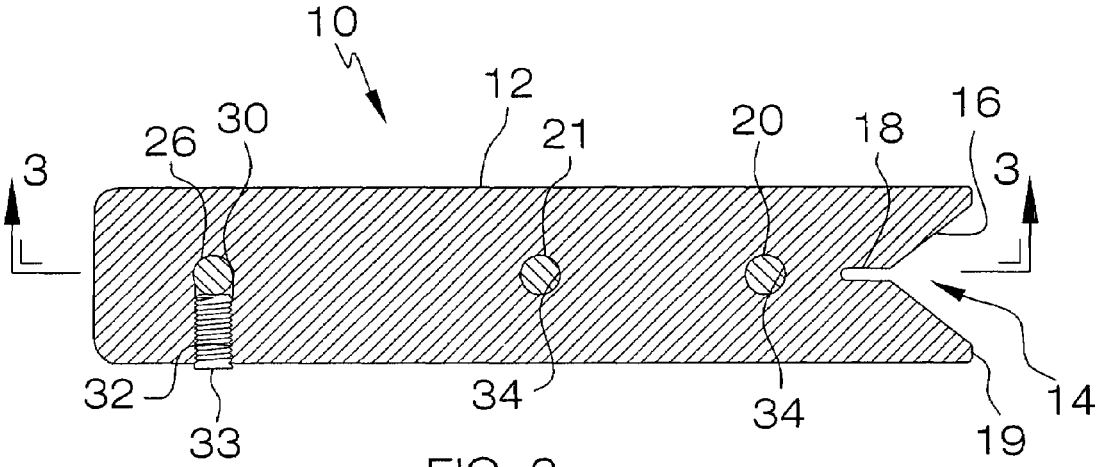
FIG. 2 is a cross sectional view of FIG. 1, taken along the line 2-2.
Figure 3:
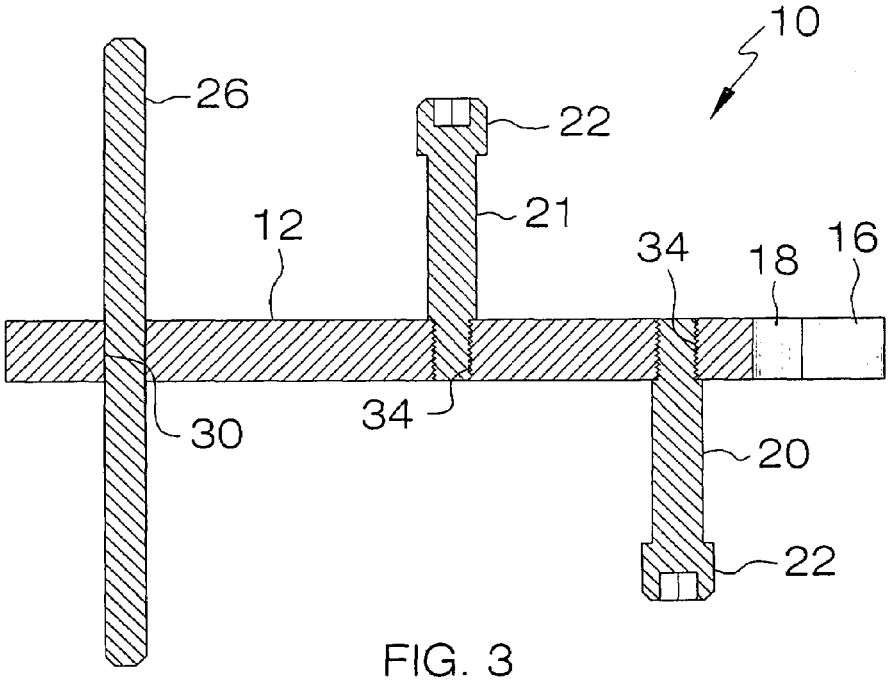
FIG. 3 is a cross sectional view of FIG. 2, taken along the line 3-3.

Referring to FIGS. 2 and 3, bolt 20 and bolt 21 are threadably secured in a spaced apart disposition within the holder 12 via threaded bores 34, respectively. Bolt 20 extends from the top of the holder 12. Bolt 21 extends from the bottom of the holder 12. The guide pin 26 is selectively disposed with equal extension from the top and the bottom of the holder 12. The set screw 33 holds the guide pin 26 as chosen, via the threaded set screw opening 32. Loosening and tightening the set screw 33 allows guide pin 26 removal and selective positioning, respectively.

Figure 4:
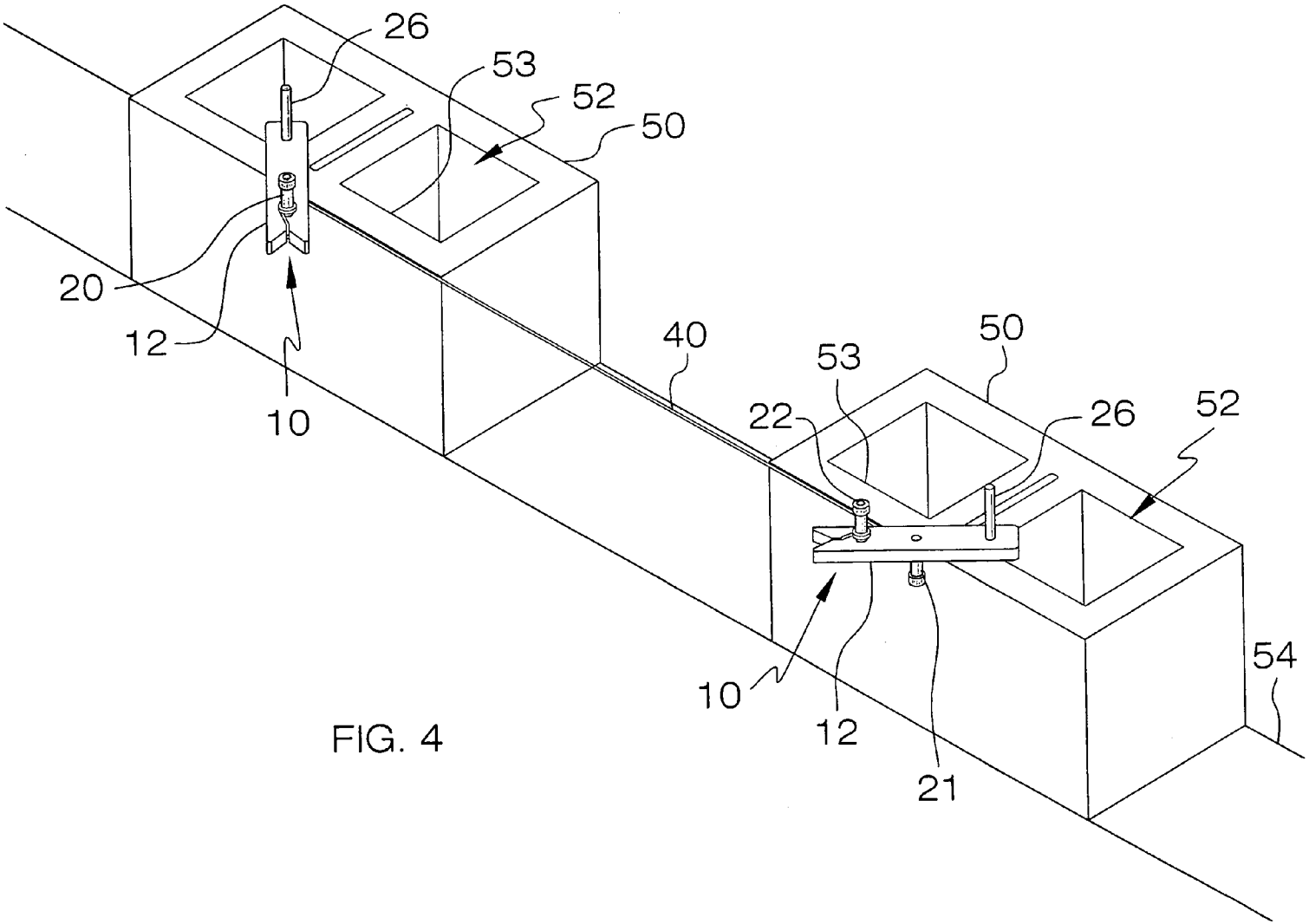
FIG. 4 is a perspective view of the apparatus in use.

Referring to FIG. 4, the apparatus 10 is in use in aligning the construction of the brick wall 54. Each of the pair of holders 12 is positioned on a vertical member 53 of a brick 50. Each holder 12 top is facing upwards. The string 40 temporarily secures the holders 12 in position.

Referring to each separate remotely disposed brick 50, a holder 12 is positioned with the holder 12 top facing upward and with the guide pin 26 removably fitted within the brick hollow 52. Each remotely spaced holder 12 is drawn toward the other via string 40 tension. The string 40 is secured to one of the holders 12. Securing the string 40 is most easily done by wrapping a segment of the string 40 around bolt 20, then passing the string 40 through the wedge 18 to secure the string 40 against slippage. The string 40 is then wrapped around the bolt 21. The string 40 is extended to the remote second holder 12. The string 40 is pulled taught and wrapped around the bolt 21 of the remotely positioned second holder 12. The string 40 is then passed through the wedge 18 and removably secured around the bolt 20. Pulling the string taught temporarily secures the opposed holders 12 in position in an interference bind with each brick 50, respectively. The string 40 thereby forms an alignment tool for the mason to align all bricks 50 between those engaged by the holders 12. Loosening the string 40 from either holder 12 allows removal of the apparatus 10.

Additionally, either or both holders 12 of the apparatus 10 may be inverted with respect to top and bottom of the holders 12. When the holders 12 are inverted, the bolt 20 is against the vertical member 53 of the brick. The bolts 20 and 21 are therefore used inversely regarding the above procedure with the string 40. The top or bottom of either holder 12 can face a brick 50. As the distance from the guide pin 26 to each stagger bolt 20 and 21 differs, turning the top or the bottom side of the holder 12 upward offers removable fitment to bricks 50 of different widths.

Turning the top of a holder 12 upward provides the shortest distance spread between brick 50 engaging components which are the guide pin 26 and the bolt 21. Turning the bottom of the holder 12 upward offers the longest distance spread between brick engaging components of the apparatus 10, namely the bolt 20 and the guide pin 26. The distance between the bolt 20 and the guide pin 26 is greater than the distance between the bolt 21 and the guide pin 26. The greater distance provides for fitting wider brick vertical members 53 and wider bricks (not shown) with the apparatus 10.

With respect to the above description then, it is to be realized that the optimum dimensional relationships for the parts of the brick laying alignment apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the brick laying alignment apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the brick laying alignment apparatus may be used.

Therefore, the foregoing is considered as illustrative only of the principles of the brick laying alignment apparatus. Further, since numerous modifications and changes will readily occur to those skilled in the art, it is not desired to limit the brick laying alignment apparatus to the exact construction and operation shown and described, and accordingly, all suitable modifications and equivalents may be resorted to, falling within the scope of the brick laying alignment apparatus.

What is claimed is:

1. A brick laying alignment apparatus, comprising:

a pair of separate parallelepiped identical holders, each holder comprising a length, a width, a thickness, a first end and a second end, and a top and a bottom, each holder further comprising:

a wedge in the first end, the wedge open to an outer surface of the first end, the wedge for removable receipt of a string;

a guide pin proximal to the second end of the holder, the guide pin perpendicular to the length of the holder, the guide pin extended from both the top and the bottom of the holder;

a first stagger bolt of the holder, the first stagger bolt proximal to the wedge, the first stagger bolt projected perpendicularly from the top of the holder;

a second stagger bolt spaced medially apart from the first stagger bolt, the second stagger bolt projected perpendicularly from the bottom of the holder.

2. The apparatus in claim 1 wherein the guide pin is removable.

3. The apparatus in claim 2 wherein the guide pin is selectively secured by a securing means.

4. The apparatus in claim 3 wherein the guide pin securing means comprises:

a set screw opening in the holder;

a set screw fitted to the set screw opening.

5. The apparatus in claim 1 wherein the first stagger bolt is removable.

6. The apparatus in claim 2 wherein the first stagger bolt is removable.

7. The apparatus in claim 3 wherein the first stagger bolt is removable.

8. The apparatus in claim 4 wherein the first stagger bolt is removable.

9. A brick laying alignment apparatus, comprising:

a pair of separate parallelepiped identical holders, each holder comprising a length, a width, a thickness, a first end and a second end, and a top and a bottom, each holder further comprising:

a vee in the first end, the vee having a length and width, the vee length coplanar to the holder length, the vee width coplanar to the holder width;

a wedge in a bottom of the vee;

a guide pin orifice proximal to the second end, the pin orifice through the thickness of the holder;

a guide pin through the guide pin orifice, the guide pin extending from both the top and the bottom of the holder;

a first stagger bolt removably affixed to the holder, the first stagger bolt proximal to the wedge, the first stagger bolt projected perpendicularly from the top of the holder;

a second stagger bolt removably affixed to the holder, the second stagger bolt spaced medially apart from the first stagger bolt, the second stagger bolt projected perpendicularly from the bottom of the holder.

10. The apparatus in claim 9 wherein each holder further comprises a threaded bore for each stagger bolt, each stagger bolt threadably removable from each threaded bore.

11. The apparatus in claim 10 wherein the guide pin is selectively removable.

12. The apparatus in claim 9 wherein the guide pin is selectively removable.

13. The apparatus in claim 9 wherein each holder is further comprised of a set screw opening adjacent to the guide pin;

a set screw fitted within the set screw opening, the set screw for selective retention of the guide pin.

14. The apparatus in claim 9 wherein the first stagger bolt and the second stagger bolt are each comprised of an externally rounded internal hex wrench head.

15. The apparatus in claim 10 wherein the first stagger bolt and the second stagger bolt are each comprised of an externally rounded internal hex wrench head.

16. The apparatus in claim 12 wherein the first stagger bolt and the second stagger bolt are each comprised of an externally rounded internal hex wrench head.

17. The apparatus in claim 11 wherein the first stagger bolt and the second stagger bolt are each comprised of an externally rounded internal hex wrench head.

18. The apparatus in claim 13 wherein the first stagger bolt and the second stagger bolt are each comprised of an externally rounded internal hex wrench head.

19. A brick laying alignment apparatus, comprising:

a pair of separate identical holders, each holder comprising a length, a width, a thickness, a first end and a second end, and a top and a bottom, each holder further comprising:

a vee in the first end, the vee having a length and width, the vee length coplanar to the holder length, the vee width coplanar to the holder width;

a ramp forming each of an opposite side of the vee;

a taper at an outer origination of each ramp, each taper joining a side of the thickness of the holder with one of the ramps of the vee;

a wedge in an inner notch of the vee, the wedge open to the top of the holder, the bottom of the holder, and a bottom of the vee, the wedge adjoining each ramp;

a guide pin orifice through the thickness of the holder, the pin orifice proximal to the second end of the holder;

a guide pin removably fitted through the guide pin orifice;

a set screw opening in the holder, the set screw opening adjacent to the pin orifice, the set screw opening perpendicular to the pin orifice;

a set screw fitted within the set screw opening, the set screw for selectively retaining the guide pin;

a first threaded bore proximal to the wedge, the first threaded bore parallel to the guide pin orifice;

a second threaded bore medially spaced apart from the first threaded bore, the second threaded bore parallel to the first threaded bore;

a first stagger bolt removably affixed within the first threaded bore;

a second stagger bolt removably affixed within the second threaded bore.

20. The apparatus in claim 19 wherein the first stagger bolt and the second stagger bolt are each comprised of an externally rounded internal hex wrench head.

* * * * *